US005222631A

United States Patent [19]

Hood

[11] Patent Number: 5,222,631

[45] Date of Patent: Jun. 29, 1993

[54] REMOVABLE LIQUID CONTAINER FOR INSULATED COOLERS

[76] Inventor: Willis E. Hood, P.O. Box 142, Gladewater, Tex. 75647

[21] Appl. No.: 680,095

[22] Filed: Apr. 3, 1991

[51] Int. Cl.[5] ..... B67D 5/60

[52] U.S. Cl. ..... 222/131; 222/185; 222/537

[58] Field of Search ..... 222/131, 181, 183, 185, 222/325, 501, 507, 537; 248/311.3, 205.2; 62/389, 391, 400, 457.1, 457.4, 457.7, 457.8; 251/149.6, 149.7; 206/545

[56] References Cited

U.S. PATENT DOCUMENTS

| | | | |
|---|---|---|---|
| Re. 22,837 | 1/1947 | Sanchis | 222/501 |
| 69,272 | 9/1867 | Tibbals | 206/545 |
| 474,387 | 5/1892 | Iler | 62/389 |
| 793,509 | 6/1905 | Cooke | 251/149.7 |
| 1,018,924 | 2/1912 | Patnaude | 62/400 |
| 1,489,754 | 4/1924 | Fruen | 62/389 |
| 3,145,653 | 8/1964 | Lake | 222/181 |
| 4,030,690 | 6/1977 | Hanauer et al. | 248/311.3 |
| 4,162,029 | 7/1979 | Gottseger et al. | 222/131 |
| 4,984,717 | 1/1991 | Burton | 222/183 |

*Primary Examiner*—Andres Kashnikow
*Assistant Examiner*—Philippe Derakshani
*Attorney, Agent, or Firm*—Ronald B. Sefrna

[57] ABSTRACT

The present invention discloses a removable liquid container for insulated coolers which allows the dispensing or withdrawing of liquid from a separate interior container without opening the outer insulated container. The removable liquid container for insulated coolers of the invention generally comprises an uninsulated liquid container to be removably installed in the interior of a conventional insulated container and configured and dimensioned to take up only a portion of the interior of the insulated container. The invention further comprises a dispensing valve to be placed in and through the wall of the insulated container, or alternatively through the existing drainage port of the insulated container, if present, in order to discharge the liquid from within the removable interior container.

20 Claims, 7 Drawing Sheets

REMOVABLE LIQUID CONTAINER FOR INSULATED COOLERS

FIELD OF THE INVENTION

The present invention generally relates to the field of beverage or other liquid containers and dispensers, and more particularly relates to a separate uninsulated beverage or other liquid container adapted to be removably installed in the interior of an insulated container and configured and dimensioned to take up only a portion of the interior of the insulated container. The invention further provides a means for dispensing or withdrawing liquid from the uninsulated container without opening the outer insulated container.

BACKGROUND OF THE INVENTION

The general and recreational use of insulated containers, such as "water cans" or "ice chests", to hold, especially, beverages and other food items is well known and such containers are effective in holding beverages or other items at or near a desired temperature over an extended period of time. Primarily, such containers are utilized to refrigerate beverages or other items by disposing a supply of ice within the container, but such containers are also utilized to warm rather than refrigerate beverages or other items. Such containers, however, are customarily designed to provide a single interior compartment capable of holding only a single volume of liquid, especially the "water can" type, with some containers further providing a valve for dispensing liquid from the interior. "Ice chest" type containers typically are not provided with a dispensing valve for such a purpose, but must be opened to access the interior, though they do allow the storage of several discrete containers therein. Some "ice chest" type containers, however, do provide a drainage port for draining water from within the interior as the ice within the container melts.

Various approaches to dispensing beverages or other liquids have been attempted and are known in the prior art, but none of the approaches have amply satisfied the adaptability, removability, and interchangeability problems. Beverage or other liquid dispensers are known in the prior art, as illustrated by U.S. Pat. No. 4,162,029 to Gottsegen et al., which discloses a removable vertically positioned uninsulated and tapered container with special lugs disposed on each side thereof, a large top opening with lid closure, and a lower end wall hole capable of accepting a threaded dispenser tap and threaded nut assembly. The Gottsegen patent further discloses that the tapered container is disposed adjacent to one end wall of a cooler, similar to an "ice chest" type container, with the special lugs thereon to cooperatively engage wedge-shaped retaining shoulders in the interior side walls of the cooler, and upon proper positioning of the tapered container within the cooler, the lower end wall hole and the corresponding hole in the cooler end wall will properly align so as to allow the securing of the dispenser tap assembly. This approach, however, does not address the interchangeability between various conventional insulated containers since the special molded lugs disposed on each side of the interior container and the special wedge-shaped retaining shoulders on the side walls of the insulated container requires a specially formed and non-conventional insulated container. This approach also fails to address the adaptability between various conventional insulated containers since the interconnection between the interior container and the insulated container only employs the aforementioned special molded lugs and mating retainer shoulders, besides the dispenser tap assembly, without providing an approach for interconnecting the interior container to another conventional insulated container without the mating retainer shoulders. Furthermore, the inner container must be installed prior to filling the inner container or emptied prior to removal since the threaded nut must be positioned onto or removed from the dispensing tap from inside the inner container through the large top opening.

U.S. Pat. No. 4,249,392 to Hotta discloses a horizontally positioned heat transferable interior container with a hole at one end. The interior container is incorporated within the outer insulated container with lid, similar to an "ice chest" type container, and suspended upwardly from the space therein by being attached to the upper portion of the outer container or the inner surface of the lid. The Hotta patent discloses a detachable supporting means for the interior container to the upper portion of the outer container by providing specially formed holders to specifically accommodate the interior container; additionally, the Hotta patent discloses a detachable supporting means for the interior container to the lid by using elongated bands. The Hotta patent further discloses liquid removal from the interior container being accomplished by means of a valve or air pump. The Hotta patent primarily discloses the use of this inner container as a heating or cooling source for the insulated container by respectively pouring preheated water into the inner container or pouring water into the inner container and then freezing the water. The Hotta patent secondarily discloses the use of the liquid of the inner container as a drinking source. The Hotta patent apparently anticipates the interior container to be directly related to, and an interfacing part of, a particular outer insulated container. Therefore, this approach, although addressing the adaptability problem by providing a detachable attachment means, does not address the interchangeability problem.

Of lesser pertinence, U.S. Pat. No. 1,776,307 to Bosque, U.S. Pat. No. 2,872,078 to Kennedy, and U.S. Pat. No. 2,718,985 to Tamminga each disclose an interior uninsulated liquid container, an exterior insulated container, and a dispensing system wherein each interior container occupies for the most part the entire insulated compartment rather than a portion thereof. Also the Bosque and Kennedy patents further disclose complex mechanical dispensing systems. Again, these approaches do not address the interchangeability and adaptability problems by requiring particularly designed exterior containers and dispensing mechanisms.

Insulated containers with multiple internal compartments and multiple dispensing valves are also known, as illustrated by U.S. Pat. No. 85,125 to Pietsch, U.S. Pat. No. 65,366 to Finch, U.S. Pat. No. 71,899 to Murden et al., U.S. Pat. No. 57,281 to Blocher, U.S. Pat. No. 43,498 to Haustetter, and U.S. Pat. No. 127,556 to Brady, but the approach taken by each of these patents uses internal compartments that are permanently interconnected within the insulated container, and thus does not address removability or interchangeability.

Therefore, there remains a need for a simple, internally disposed, uninsulated, and removable liquid container for insulated coolers which provides a means of externally withdrawing or dispensing liquids while remaining adaptable to and interchangeable between various conventional insulated containers.

SUMMARY OF THE INVENTION

The removable liquid container for insulated coolers of the invention provides an uninsulated liquid container to be installed in, yet remain removable from, the interior of a conventional insulated container, configured and dimensioned to take up only a portion of the interior of the insulated container. The invention further provides a dispensing valve assembly to be placed in and through the wall of the insulated container, or alternatively through the existing drainage port of the insulated container, if present, in order to dispense the liquid from within the removable interior container without opening the insulated container.

The insulated container typically comprises a double-walled, insulated, and portable structure with a removable or hinged lid for access to the interior. The uninsulated container of the invention is a separate container designed to be interconnected to the interior of the insulated container in such a manner that the uninsulated container can be readily removed without damage to either the uninsulated or insulated container. This removability thus allows the user to have a greater useful interior volume in the insulated container if desired or permits the user to relocate and use the uninsulated container in another insulated container if desired. With the uninsulated container being provided, the user can supply the liquid to be dispensed and place the liquid in the uninsulated container without having to be concerned about finding another container that will seal and fit within the insulated container.

Additionally, the uninsulated container as positioned in a "ice chest" type container eliminates the need to constantly open the "ice chest" in order to gain access to the beverage or the like therein which more efficiently conserves the supplied heating or cooling source therein. Also, the uninsulated container as positioned in a "water can" type container allows an additional or alternative liquid to be dispensed without adversely affecting the other liquid contained therein. For example, the "water can" could contain sweetened tea for a majority of users while the uninsulated container could contain unsweetened tea for the remaining users, or vice versa if desired.

The uninsulated container further allows a dispensing valve assembly to be interconnected thereto forming a seal so as to contain the liquid therein and prohibit leakage from one container to the other. The dispensing valve assembly allows the withdrawing of liquid from the uninsulated container to be accomplished easily and without having to open the insulated container. A conventional check valve in coordination with a venting system is also provided to further facilitate the steady dispensing of the beverage or the like and to maintain the characteristics, such as carbonation, of the liquid contained within the uninsulated container. Furthermore, the dispensing valve assembly forms a seal with the insulated container when placed in and through the insulated container, or alternatively through the drainage port of the insulated container, to prohibit leakage from the insulated container to the exterior of the insulated container.

Alternatively, instead of providing a particular uninsulated container, the device of the invention may provide a "bottle adapter cap" and a bottle holder to be used in conjunction with a conventional bottle such as a soda bottle. The "bottle adapter cap" interconnects with a conventional bottle neck replacing the conventional bottle cap and forming a seal therewith. A conventional check valve in coordination with a venting system is also provided to facilitate the steady flow of beverage or the like and to maintain the characteristics of the liquid contained within the conventional bottle. The "bottle adapter cap" also interconnects with the dispenser valve assembly forming a seal therewith.

Among the objects of this invention, one object is to provide a new and novel beverage or other liquid dispenser which is interchangeable between conventional insulated containers.

Another object of this invention is to provide a new and novel beverage or other liquid dispenser which is capable of being secured to the interior of various conventional insulated containers.

A further object of this invention is to provide a new and novel beverage or other liquid dispenser which remains readily removable from the insulated container.

A still further object of this invention is to provide a new and novel beverage or other liquid dispenser which is refillable and reusable, preferably of a rigid or semi-rigid construction, or has a single use and is thereafter disposable, possibly constructed of a plastic film material.

Yet another object of this invention is to provide a new and novel beverage or other liquid dispenser which has a dispensing valve assembly capable of penetrating and extending in and through the insulated container wall, or alternatively extending through an existing insulated container drainage port.

The structure and features of the preferred and alternative embodiments of the invention will now be described in detail, with reference to the accompanying drawing figures.

DETAILED DESCRIPTION OF THE INVENTION

Figure 1:
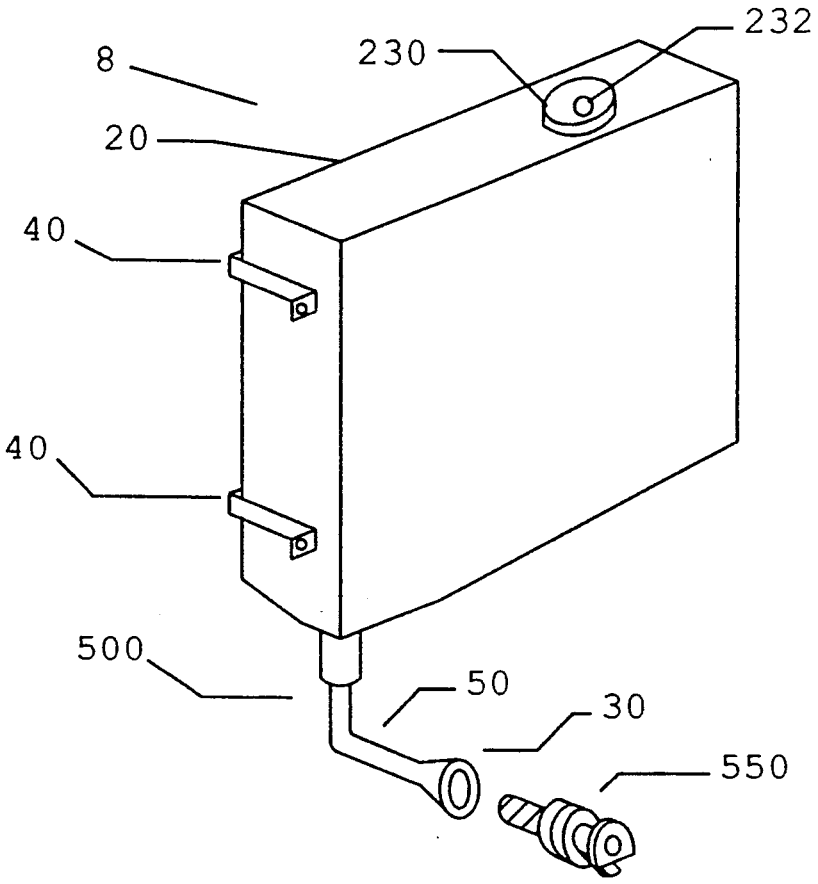
FIG. 1 is a perspective view of the preferred embodiment of the removable liquid container for insulated coolers of the invention for the "ice chest" type container.
Figure 2:
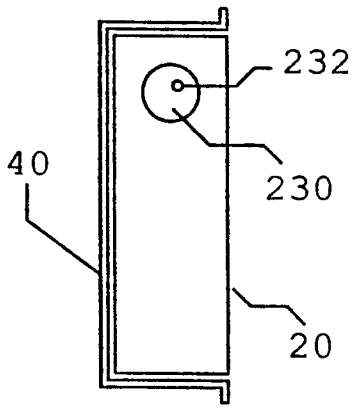
FIG. 2 is a plan view of the preferred embodiment of the removable liquid container for insulated coolers of the invention for the "ice chest" type container.
Figure 3:
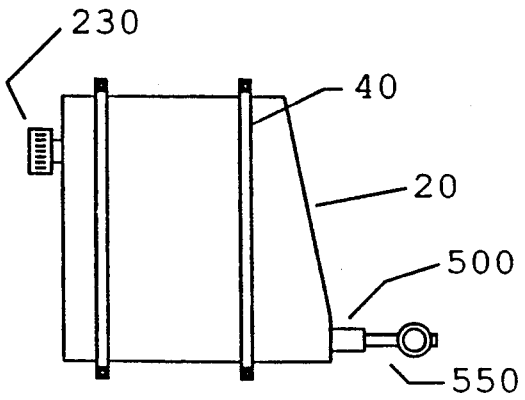
FIG. 3 is a side view of the preferred embodiment of the removable liquid container for insulated coolers of the invention for the "ice chest" type container.
Figure 4:
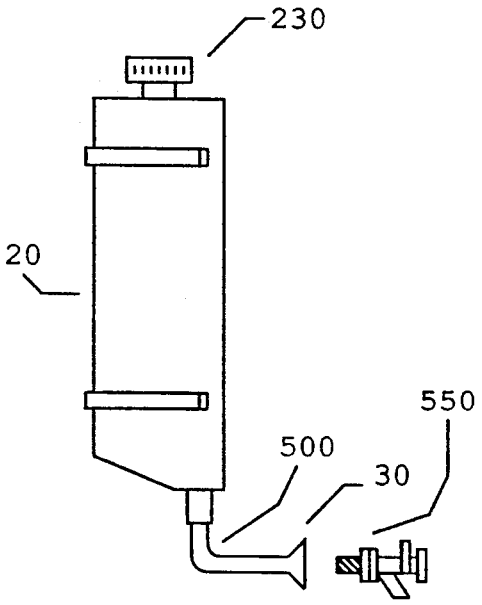
FIG. 4 is an end view of the preferred embodiment of the removable liquid container for insulated coolers of the invention for the "ice chest" type container.
Figure 7:
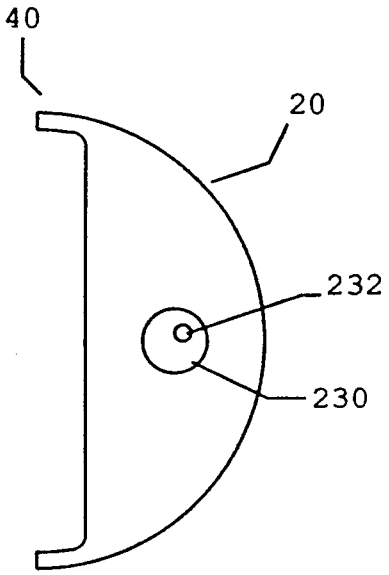
FIG. 7 is a plan view of the preferred embodiment of the removable liquid container for insulated coolers of the invention for the "water can" type container.
Figure 6:
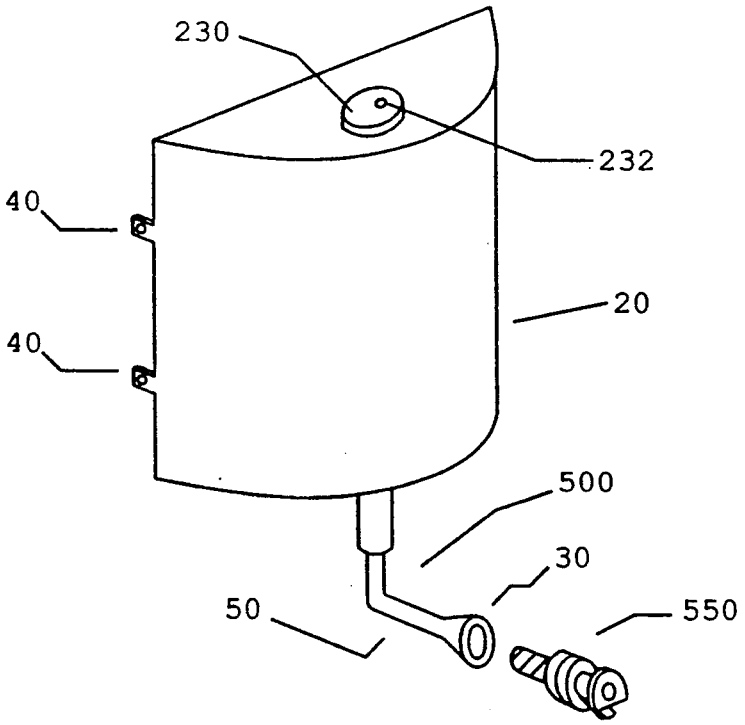
FIG. 6 is a perspective view of the preferred embodiment of the removable liquid container for insulated coolers of the invention for the "water can" type container.
Figure 5:
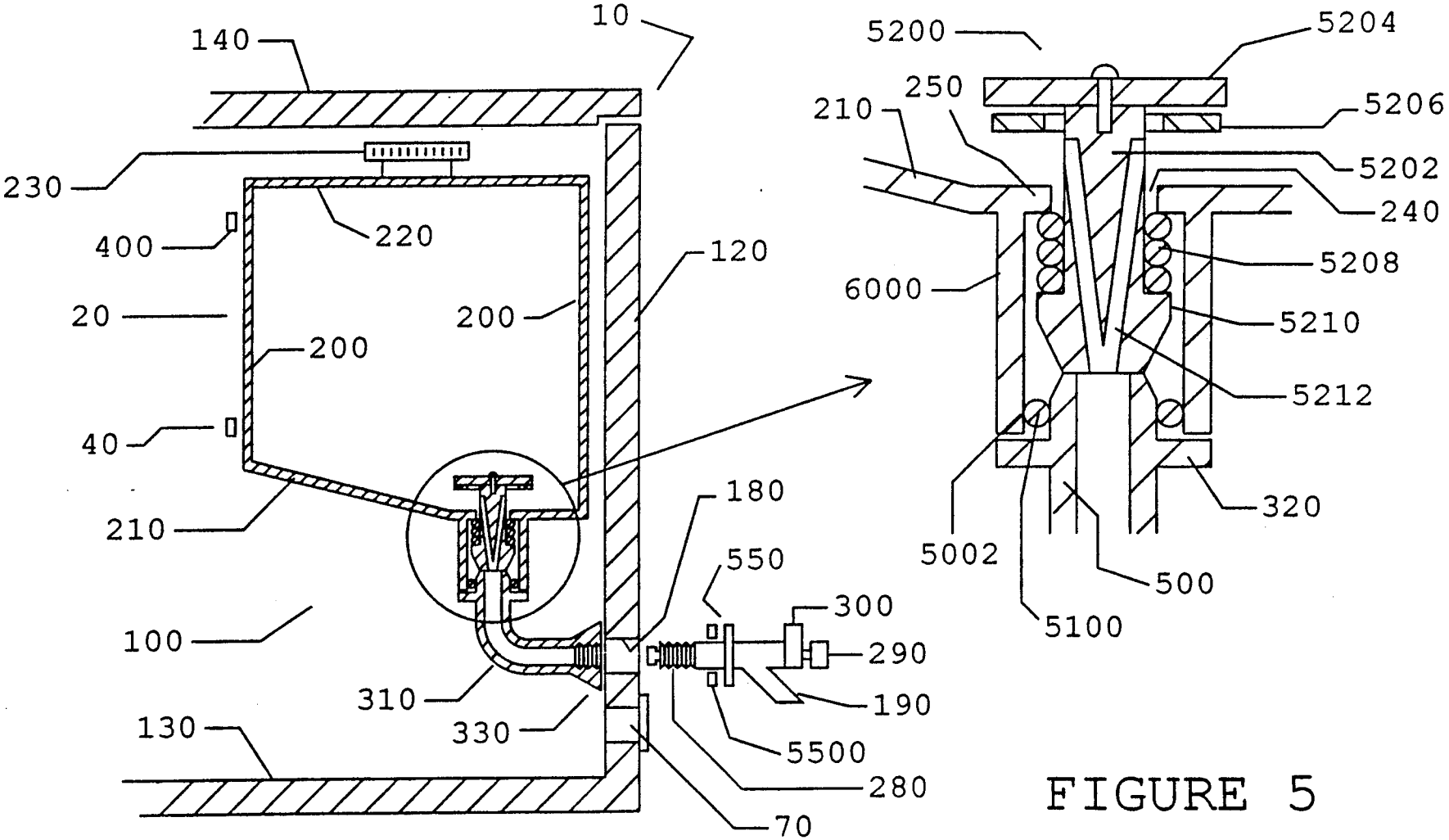
FIG. 5 is a sectional view of the preferred embodiment of the removable liquid container for insulated coolers of the invention positioned in an "ice chest" type container.
Figure 8:
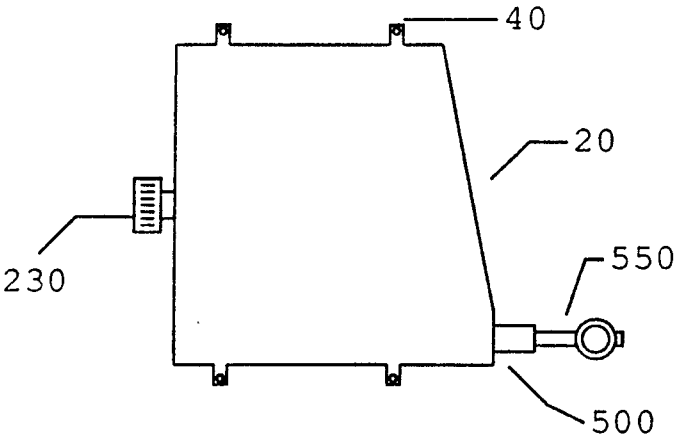
FIG. 8 is a side view of the preferred embodiment of the removable liquid container for insulated coolers of the invention for the "water can" type container.
Figure 9:
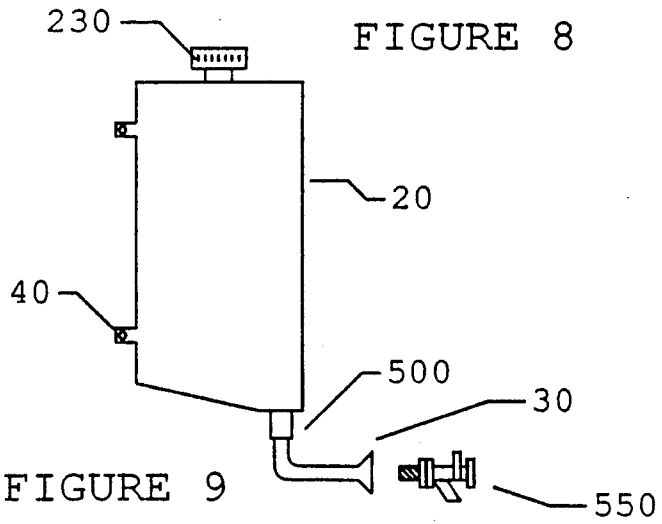
FIG. 9 is an end view of the preferred embodiment of the removable liquid container for insulated coolers of the invention for the "water can" type container.

With reference to the fourteen (14) accompanying drawing figures, the removable liquid container for insulated coolers of the invention, generally designated by reference numeral 8, is shown to comprise an insulated container 10 having a dispensing valve aperture 180, an uninsulated liquid container 20, a dispensing valve assembly 30 having a spout 190, valve actuating means 290 and an elongated valve nipple 280 extending through the dispensing valve aperture, a retaining assembly 40, and an interconnecting assembly 50 having (a) an interconnection and sealing means 500 between dispensing valve assembly 30 and uninsulated liquid container 20 and (b) an interconnection and sealing means 550 between dispensing valve assembly 30 and insulated container 10.

Said insulated container 10 usually is of either the "ice chest" type container or of the "water can" type container. The "ice chest" type container generally comprises an interior compartment 100 formed by a pair of side walls 110, a pair of end walls 120 perpendicular and interconnected to side walls 110, a bottom 130 interconnected to side walls 110 and end walls 120, and a top closure 140 being either hinged to, typically, one of side walls 110, or fully removable. In many "ice chest" type containers, a discharge port 70 is provided to drain interior compartment 100. The "water can" type container generally comprises interior compartment 100 but is formed by a cylindrically-shaped side wall 150, a circular bottom 160 interconnected to side wall 150, and a circular top closure 170 being generally removable and interconnected to side wall 150 by a flexible cord or the like.

Said uninsulated liquid container 20 is configured and dimensioned to take up only a portion of said interior compartment 100 of said insulated container 10, and generally comprises a hollow body having side walls 200, a bottom closure 210 interconnected to side walls 200 and having a portion of interconnection and sealing means 500 integrally formed therewith (aftermentioned protrusion 5000), preferably sloping down towards the outlet of interconnecting assembly 50 so as to enable complete dispensing of the liquid contents from uninsulated liquid container 20, and a top 220 interconnected to side walls 200 and having a circular opening of sufficient size so as to be capable of accepting fluids and particular solids, e.g. ice fragments or cubes, with a sealable closure cap 230. The height of uninsulated liquid container 20 may be such that uninsulated liquid container 20 fills almost all of the vertical space within insulated container 10 so as to prevent uninsulated liquid container 20 from floating as it is being emptied. Closure cap 230 preferably incorporates a venting system 232 by providing a sealable orifice which performs the collective functions of the venting system and the conventional check valve so as to allow external air to enter uninsulated container 20 when liquid is being withdrawn therefrom but prevent internal air or liquid within uninsulated container 20 from escaping therefrom.

Said dispensing valve assembly 30 further comprises a conventional externally threaded dispensing valve 300 and a tubular liquid conduit 310 having first and second ends with an annular raised shoulder 320 disposed between the first and second ends thereof, preferably closer to the second end thereof. The second end of liquid conduit 310 is preferably chamfered so as to facilitate mating said liquid conduit 310 with interconnection and sealing means 500. The first end thereof is preferably formed as a conically shaped flat based internally threaded end 330 to accept conventional dispensing valve 300.

Said retaining assembly 40 preferably comprises a flexible connection strap element 400 which allows said uninsulated liquid container 20 to be installed and removed by attaching or detaching said connection strap element 400, or a plurality of said connection strap elements 400, to said side wall 110 and/or said end wall 120 of said insulated container 10. The attachment of said connection strap element(s) 400 to said side wall 110 and/or end wall 120 may be accomplished by using such mechanisms as plastic expandable inserts with nylon screws or securely attached "Velcro" fasteners. Said connection strap element(s) 400 should restrain uninsulated liquid container 20 from movement laterally so as to prevent such movement of uninsulated liquid container 20 from adversely affecting interconnection and sealing means 500 and 550. Additionally, connection strap element(s) 400 should restrain uninsulated liquid container 20 from vertically so as to prevent uninsulated liquid container 20 from floating as it is emptied which movement would again adversely affect interconnection and sealing means 500 and 550; or the height of uninsulated liquid container 20 may be adjusted to fill almost all of the vertical space within insulated container 10, thereby preventing vertical movement of uninsulated liquid container 20.

Figure 12:
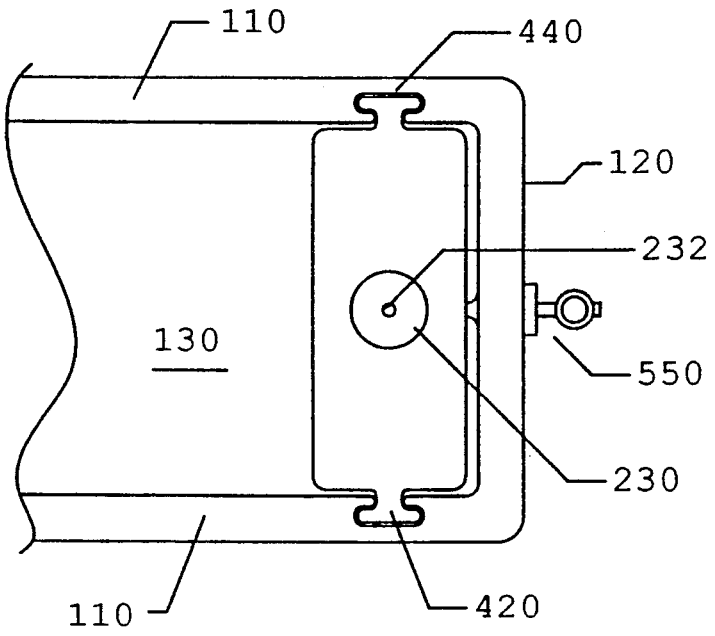
FIG. 12 is a partial sectional top view of the removable liquid container for insulated coolers of the invention positioned in an "ice chest" type container, illustrating a first alternative embodiment of the retaining assembly.
Figure 13:
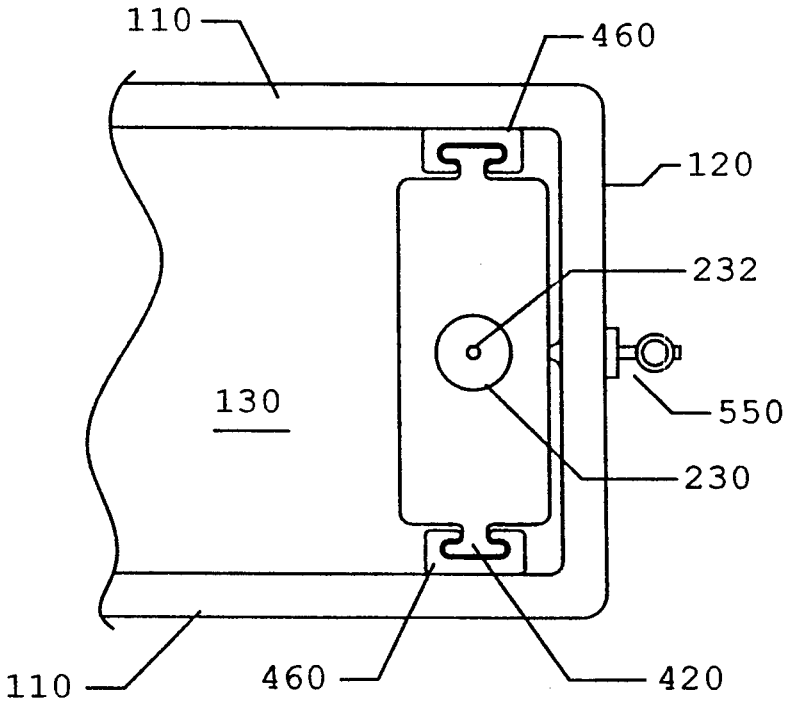
FIG. 13 is a partial sectional top view of the removable liquid container for insulated coolers of the invention positioned in an "ice chest" type container, illustrating a second alternative embodiment of the retaining assembly.
Figure 14:
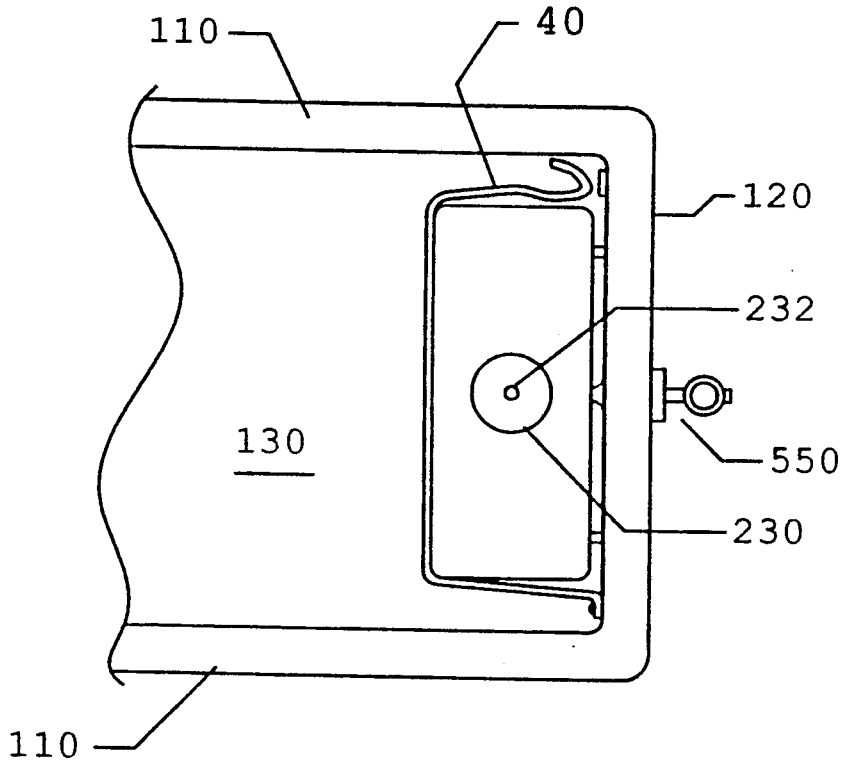
FIG. 14 is a partial sectional top view of the removable liquid container for insulated coolers of the invention positioned in an "ice chest" type container, illustrating the preferred embodiment of the retaining assembly.

In alternative embodiments, retaining assembly 40 may comprise lugs extending outwardly from side walls of uninsulated container 20 to mate with slots formed in the side walls of insulated container 10 or with channels interconnected to such side walls of insulated container 10. More specifically, in one such alternative, uninsulated container 20 includes lugs 420 extending outwardly from side walls 200, to be received in slots 440 formed in side walls 110 of an "ice chest" type container, as illustrated in FIG. 12, or in an end wall 120 of such a container. Similarly, in the context of an uninsulated container 20 to be received in a "water can" type container, lugs 420 extend outwardly from the curved side wall of said container 20 and are received in slots 440 formed in annular wall 150. This alternative retaining assembly 40 may also be provided in a slight variation from the structure disclosed immediately above, suitable for installation in an existing container 10, by providing channels 460 to be interconnected, by adhesive or other suitable conventional means, to the inner surface of the appropriate wall or walls of container 10, as illustrated in FIG. 13.

Said interconnecting and sealing means 500 of interconnecting assembly 50 further comprises a hollow tubular connecting nipple 5000 interconnected to uninsulated liquid container 20, preferably formed integrally with bottom closure 210, around outlet aperture 240, so as to enable complete dispensing of the liquid contents of uninsulated liquid container 20, or, alternatively, integrally formed with one of side walls 200 if desired, a rubber o-ring 5100, and a spring-loaded impeding valve 5200 having an extension to interact with the first end of dispensing valve stem 310. Said connecting nipple 5000 is constructed with an inner recessed groove 5002 capable of securing internally appropriately sized rubber o-ring 5100 with said rubber o-ring 5100 also being appropriately sized to accept, with minimal resistance, said liquid conduit 310 upon insertion of said liquid conduit 310 into said connecting nipple 5000. Upon the insertion of said liquid conduit 310 into said connecting nipple 5000, a seal between said liquid conduit 310 and said rubber o-ring 5100 is developed and a concurrent seal between said rubber o-ring 5100 and said connecting nipple 5000 of said uninsulated container 20 is also developed. Impeding valve 5200 further comprises elongate shaft 5202 with a first and second end where the first end is chamfered and the second end is flat and further has a protruding ledge 5210 and discharging ports 5212, sealing pressure cap 5204 interconnected to the second end of elongate shaft 5202, rubber seal 5206 positioned adjacent to sealing pressure cap 5204, and spring 5208 positioned with one end on protruding ledge 5210 and the other on ledge 250 formed by the edge of outlet aperture 240 in bottom closure 210 of uninsulated container 20. Impeding valve 5200 is biased by spring 5208 to seal the opening of uninsulated liquid container 20 so as to allow uninsulated liquid container 20 to be filled prior to placement within insulated container 10, whereby the seal formed by impeding valve 5200 is broken after dispensing valve stem 310 interconnects with rubber o-ring 5100 and upon the complete insertion of the second end of dispensing valve stem 310, thereby dislodging said impeding valve 5200. The insertion of dispensing valve stem 310 is complete when said raised shoulder 320 of said dispensing valve stem 310 contacts said protrusion 5000. When impeding valve 5200 is dislodged, the liquid contents of uninsulated container 20 can flow into and through discharging ports 5212 and then into liquid conduit 310.

Said interconnection and sealing means 550 of interconnecting assembly 50 further comprises a flat resilient washer 5500 that is compressed upon rotation of conventional dispensing valve 300 as said conventional dispensing valve 300 is threadably engaged with the first end of liquid conduit 310. Similarly as with said interconnection and sealing means 500, upon dispensing valve 300 being threadably engaged with liquid conduit 310, a seal between wall 120 of said insulated container 10 and said liquid conduit 310 is developed.

In the preferred embodiment, the uninsulated liquid container 20 is designed to be refillable and reusable, and preferably constructed of a rigid or semi-rigid material so as to structurally provide the necessary rigidity for said connecting nipple 5000 and to minimize the risk of puncturing uninsulated liquid container 20. The shape of uninsulated liquid container 20 is adapted to conform to the type of insulated container employed. If an "ice chest" type container is used, uninsulated liquid container 20 would typically comprise a pair of side walls positioned parallel to one another, a pair of narrower parallel side walls positioned perpendicular to the side walls and interconnected thereto, a sloped rectangularly-shaped bottom closure interconnected to the side walls and having a portion of interconnection and sealing means 500 integrally formed therewith, and a rectangularly-shaped top interconnected to the side walls and having a circular opening with a sealable closure cap. If a "water can" type container is used, uninsulated liquid container 20 would typically comprise a longitudinally truncated cylindrically-shaped body with a curved side wall with a first and second longitudinal end, a planar side wall interconnecting the two longitudinal ends of the curved side wall, a sloped circularly-truncated bottom closure interconnected to the two side walls and having a portion of interconnection and sealing means 500 integrally formed therewith, and a top closure interconnected to the two side walls and having a circular opening with a sealable closure cap.

In an alternative embodiment, said uninsulated liquid container 20 may be designed as a single use and disposable container. Said uninsulated liquid container 20 may be constructed of a flexible material, e.g. a plastic film, capable of accepting the second end of said liquid conduit 310 by puncturing a sealable membrane contained therein which provides said interconnection and sealing means 500. Additionally, uninsulated liquid container 20 may be positioned flat adjacent to bottom 130 of insulated container 10 rather than adjacent to end wall 120.

In another alternative embodiment, the conventional dispensing valve may be placed through the existing drainage port 70 of said insulated container 10, if present, and interconnected thereto. The interconnection will also provide a sealing means between liquid conduit 310 and drainage port 70 by providing an interfacing seal such as a conically-shaped rubber grommet capable of accepting internally liquid conduit 310 and sufficiently large to form a seal between said rubber grommet and said drainage port 70 of said insulated container 10.

Figure 11:
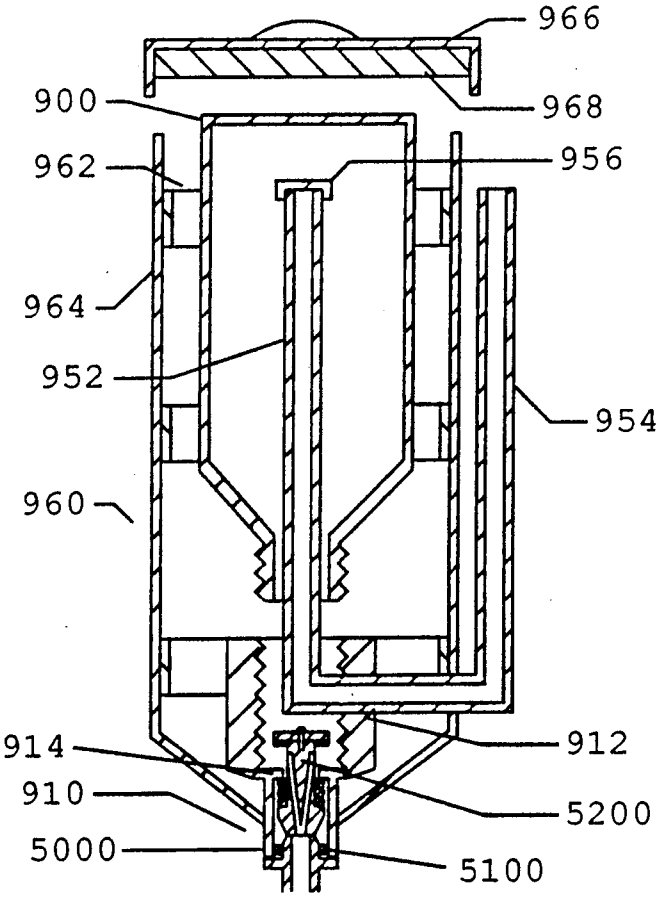
FIG. 11 is a partial sectional view of an alternative embodiment of the removable liquid container for insulated coolers of the invention for the "bottle adapter cap" design for the "ice chest" or "water can" type container.
Figure 10:
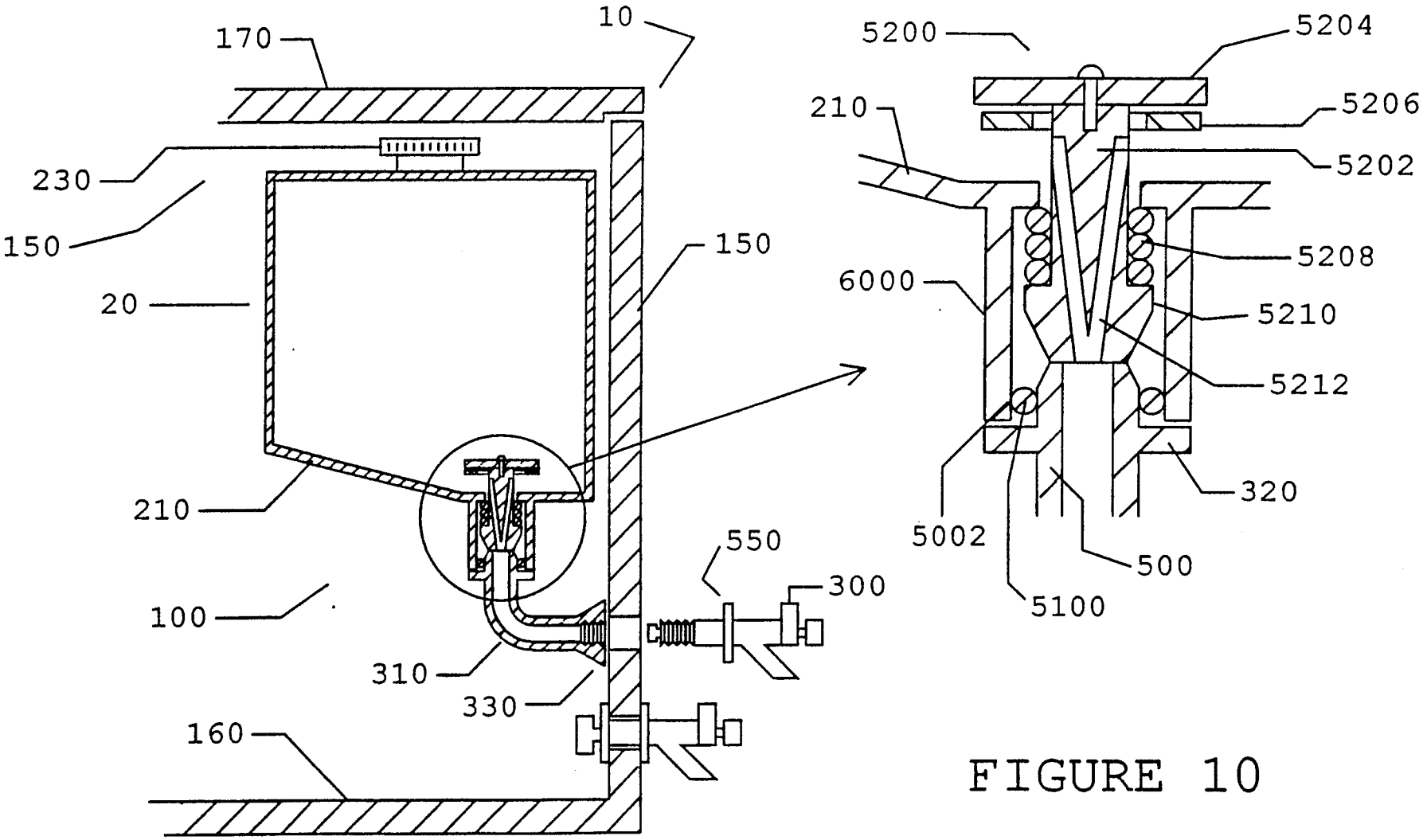
FIG. 10 is a partial sectional view of the preferred embodiment of the removable liquid container for insulated coolers of the invention positioned in a "water can" type container.

In still another alternative embodiment, illustrated in FIG. 11, said uninsulated container 20 may be a conventional or specially fabricated bottle 900, such as a soft drink bottle, inverted within insulated container 10. Interconnection and sealing means 500 is provided in the form of an interfacing "bottle adapter cap" 910 for bottle 900, to replace the regular bottle cap. The preferred embodiment of "bottle adapter cap" 910 includes a connecting nipple 5000, adapted at its second end to receive the neck of bottle 900, with o-ring 5100 and impeding valve 5200 as in the preferred embodiment of the invention, with addition of an aperture 912 to accommodate venting assembly 950, and of annular ledge 914, to receive the lower surface of cap 5204, with seal 5206 therebetween, to seal against the release of liquid from bottle 900. As illustrated, annular ledge 914 is disposed in the interior of connecting nipple 5000 between aperture 912 and the first end of connecting nipple 5000, and spring 5208 is disposed between ledge 5210 and ledge 914.

In the "bottle adapter cap" alternative embodiment, retaining means 40 may comprise a cage 960 having a plurality of circular hoops 962 with an inside diameter slightly larger than the outer diameter of the bottle 900, a plurality of longitudinal strips 964 interconnected to said hoops forming a truncated conically-shaped bottom which would hold bottle 900 in the proper inverted position, and a restraining lid 966 being slightly larger than the inside diameter of the circular hoops so as to fit snugly within the upper circular hoop and using a resilient material 968 on the lower surface of restraining lid 966 so as to compress resilient material 968 against the bottle as restraining lid 966 is placed into position in order to prevent the bottle from "floating".

Venting assembly 950 generally comprises an internal vent tube 952 having first and second ends, with the first end thereof interconnected to aperture 912, an external vent tube 954 having first and second ends with the first end thereof interconnected to aperture 912, and a conventional check valve 956. Said internal vent tube 952 is preferably cylindrical in shape, rigid, and of sufficient length to extend from aperture 912 of "bottle cap adapter" 910 to a point very near the top of the conventional bottle. Said external vent tube 954 is also preferably cylindrical in shape, but flexible, and of sufficient length to extend from aperture 912 of "bottle cap adapter" 910 through the length of bottle 900. Alternatively, a continuous vent tube, extending through aperture 912 and interconnected thereto, may be used. Said conventional check valve 956 is biased to allow external air to enter the conventional bottle while liquid is be withdrawn therefrom, but prevent the escape of air or liquid from within the conventional bottle, so as to allow a smooth flow of liquid from within the conventional bottle and to maintain desired characteristics, such as carbonation, of the liquid therein. Said check valve 956 is preferably positioned on the second end of internal vent tube 952 although it may be positioned elsewhere if desired.

The "bottle adapter cap" embodiment may be combined with the preferred embodiment of uninsulated inner container 20 to provide the advantages of both in a single structure. Such combination may be readily achieved by adding the additional elements of aperture 912, ledge 914, and venting assembly 950 to the connecting nipple 5000 of the preferred embodiment, adapting the second end of connecting nipple 5000 to receive and releasably connect to the neck of bottle 900, and by positioning the opening of top 220 in coaxial alignment with connecting nipple 5000. With such combination, a bottle 900 may be inserted through such opening and connected to the second end of connecting nipple 5000, such that uninsulated container functions as a retaining means for bottle 900, or uninsulated container 20 may be directly filled with liquid to be dispensed therefrom, as described above.

The foregoing detailed description of the preferred and alternative embodiments of the invention are illustrative, and not for purposes of limitation. The invention is susceptible to various other modifications and alternative embodiments without departing from the scope and spirit of the invention as claimed.

What is claimed is:

1. A portable insulated container with a removable uninsulated inner container for the storage and dispensing of liquids through the wall of the insulated container, comprising:

an insulated outer container having a bottom closure, a continuous side wall having an upper edge and a lower edge and an inner surface and an outer surface interconnected at its lower edge to said bottom closure, and an openable cover, said side wall having a dispensing valve aperture extending therethrough from the exterior of said outer container to the interior thereof near said lower edge of said side wall;

a hollow inner container to be removably received in and releasably interconnected in the interior of said outer container and being of substantially smaller volume than the volume of the interior of said outer container, having a bottom wall, a continuous side wall, and a top wall, said top wall having an opening therein for access to the interior of said inner container, and a removable lid to close said opening;

a dispensing valve assembly including a conventional liquid dispensing valve for controlling the flow of liquid therethrough, said liquid dispensing valve having a spout for the flow of liquid therefrom, valve actuating means, and an elongate valve nipple with an open end, said valve nipple extending through said dispensing valve aperture in said side wall of said outer container with said open end thereof in the interior of said outer container, said dispensing valve assembly further including a hollow liquid conduit with an annular wall and open first and second ends, interconnected at its first end to said open end of said valve nipple, and having a shoulder extending outwardly from said annular wall near the second end of said liquid conduit; and an interconnecting assembly for releasably interconnecting said inner container to said dispensing valve assembly, including a hollow connecting nipple with first and second ends, said first end to receive said second end of said liquid conduit into the interior of said connecting nipple with said shoulder of said liquid conduit received against said first end of said connecting nipple, said connecting nipple interconnected at its second end to and extending outwardly from the outer surface of said inner container around and in coaxial alignment with an outlet aperture penetrating from the exterior of said inner container to the interior thereof, the cross-sectional dimension of said outlet aperture being smaller than the inner cross-sectional dimension of said connecting nipple such that a first ledge is formed between the edge of said outlet aperture and the inner surface of said connecting nipple, including an impeding valve member with an elongate shank, having first and second ends, extending through said outlet aperture with the first end thereof in the interior of said connecting nipple and the second end thereof in the interior of said inner container, having a second ledge extending outwardly from said shank near said first end thereof between said shank and the inner surface of said connecting nipple, a sealing cap interconnected to said second end of said shank and extending outwardly from said shank so as to form an annular sealing surface to be received against the inner surface of said inner container around said outlet aperture to seal against the flow of liquid therethrough, said shank being penetrated by one or more discharge ports extending from the outer surface thereof adjacent to said second end to said first end thereof, each forming a passageway for the flow of liquid therethrough, and including biasing means disposed between said first ledge and said second ledge so as to force said valve member toward the first end of said connecting nipple and to force said annular sealing surface of said valve member against the inner surface of said inner container.

2. The container of claim 1, wherein said inner container is vented to allow air to flow to the interior thereof as liquid is dispensed therefrom.

3. The container of claim 1, wherein said biasing means of said interconnecting assembly comprises a coil spring disposed around said shank of said impeding valve member between said first ledge and said second ledge.

4. The container of claim 1, further comprising connecting means for releasably connecting said inner container in the interior of said outer container.

5. The container of claim 4, wherein said connecting means comprises a plurality of lugs extending outwardly from the outer surface of said side wall of said inner container, and a plurality of slots formed in the inner surface of said side wall of said outer container, to receive said lugs in sliding relation therewith.

6. The container of claim 4, wherein said connecting means comprises a plurality of straps, each having first and second ends, each connected at its first end to the inner surface of said side wall of said outer container, extending around said inner container, and releasably connected at its second end to the inner surface of said side wall of said outer container.

7. The container of claim 4, wherein said connecting means comprises a plurality of lugs extending outwardly from the outer surface of said side wall of said inner container, and a plurality of elongate members, each having an elongate slot formed therein to receive one or more of said lugs, each said member interconnected to the inner surface of said side wall of said outer container.

8. The container of claim 1, wherein the volume contained within said inner container is substantially less than the volume contained within said outer container.

9. The container of claim 1, wherein said outer container is an "ice chest" type insulated container, and said dispensing valve aperture is a drain conduit with removable plug.

10. The container of claim 1, wherein said outer container is a "water can" type insulated container with a dispensing valve for the dispensing of liquid directly from the interior thereof, such that said dispensing valve assembly for dispensing liquid from said inner container is in addition thereto.

11. The container of claim 1, wherein said inner container is configured such that said side wall of said inner container matches the configuration of said side wall of said outer container.

12. The container of claim 1, wherein the cross-sectional dimension of said outlet aperture of said inner container is approximately equal to the inner cross-sectional dimension of said connecting nipple, said second end of said connecting nipple is formed so as to receive the neck of a bottle of liquid from which liquid is to be dispensed, said first ledge is formed as an annular ledge extending into the interior of said connecting nipple from the inner surface thereof intermediate said first and second ends thereof, said sealing surface formed by said sealing cap of said impeding valve member is received against the upper surface of said annular ledge, and wherein said opening of said top wall of said inner container is coaxially aligned with said connecting nipple and is of sufficient size to receive such bottle therethrough with the neck of such bottle received in said connecting nipple.

13. The container of claim 12, wherein said interconnecting assembly further includes vent means for the purpose of allowing air to flow into the interior of the bottle as liquid is dispensed therefrom while substantially preventing the flow of liquid from the interior of such bottle through said vent means.

14. The container of claim 13, wherein said vent means comprises an elongate hollow vent tube with first and second ends, extending through the side wall of said connecting nipple between said first ledge and said second end thereof and interconnected thereto in liquid-tight relation intermediate said first and second ends of said vent tube, and extending through the interior and second end of said connecting nipple such that the first end of said vent tube may be received in the interior of a bottle, said vent tube being of sufficient length that said second end thereof may be extended along said side wall of said inner container to said top wall thereof.

15. A container apparatus for holding and dispensing liquids, to be removably received and retained in the interior of an outer container having a conventional dispensing valve and spout assembly forming a valved passageway from the interior to the exterior of the outer container for interconnection of the container apparatus of the invention, in addition to any dispensing valve and spout assembly for dispensing liquid directly from the interior of such outer container, such dispensing valve and spout assembly for interconnection of the container apparatus of the invention having an inner end extending into the interior of such outer container, comprising:

a hollow body having a bottom wall, a continuous side wall, and a top wall, said top wall having an opening therein for access to the interior of said inner container, and a removable lid to close said opening, said body including an outlet aperture penetrating a wall of said body to form a passage from the interior to the exterior thereof;

attachment means for releasably interconnecting and retaining said body in the interior of the outer container;

a hollow liquid conduit with an annular wall and open first and second ends, interconnected at its first end to the inner end of the dispensing valve and spout assembly of the outer container, and having a shoulder extending outwardly from said annular wall near the second end of said liquid conduit; and an interconnecting assembly for releasably interconnecting said body to said liquid conduit, including a hollow connecting nipple with first and second ends, interconnected at its second end to and extending outwardly from the outer surface of said body around and in coaxial alignment with said outlet aperture, the inner cross-sectional dimension of said connecting nipple being larger than the cross-sectional dimension of said outlet aperture and said connecting nipple having a first ledge extending from the inner surface of said connecting nipple to the edge of said outlet aperture along the outer surface of said body, including an impeding valve member with an elongate shank, having first and second ends, extending through said outlet aperture with the first end thereof in the interior of said connecting nipple and the second end thereof in the interior of said body, having a second ledge extending outwardly from said shank near said first end thereof between said shank and the inner surface of said connecting nipple, a sealing cap interconnected to said second end of said shank and extending outwardly from said shank so as to form an annular sealing surface to be received against the inner surface of said body around said outlet aperture to seal against the flow of liquid therethrough, said shank being penetrated by one or more discharge ports extending from the outer surface thereof adjacent to said second end to said first end thereof, each forming a passageway for the flow of liquid therethrough, and including a coil spring disposed around said shank between said first ledge of said outlet nipple and said second ledge of said shank so as to force said valve member toward the first end of said connecting nipple and to force said annular sealing surface of said valve member against the inner surface of said body until said second end of said liquid conduit is received in said connecting nipple and forces said valve member toward second end of said connecting nipple, removing said annular sealing surface from contact with said body, and allowing liquid to flow from the interior of said body through said discharge ports, said connecting nipple and said liquid conduit to the dispensing valve and spout assembly.

16. The container apparatus of claim 15, wherein the outer container is an "ice chest" type insulated container having a drain aperture, and wherein said dispensing valve and spout assembly is extended through and removably interconnected in said drain aperture in liquid-tight relation therewith.

17. A liquid dispensing apparatus for retaining a bottle or other discrete container of liquid in the interior of a larger outer container and selectively dispensing liquid from the bottle through the wall of the outer container, such outer container having a side wall and a dispensing valve aperture extending through such side wall from the interior to the exterior of the container, and such bottle or other container having an open ended neck for the release of liquid therefrom, comprising:

bottle retaining means for retaining the bottle in an inverted vertical position, with the neck of such bottle extending downward, in the interior of the outer container;

connecting means for removably connecting said bottle retaining means in the interior of the outer container with the bottle retained in an inverted vertical position therein;

a dispensing valve assembly including a conventional liquid dispensing valve for controlling the flow of liquid therethrough, said liquid dispensing valve having a spout for the flow of liquid therefrom, valve actuating means, and an elongate valve nipple with an open end, said dispensing valve assembly interconnected to the side wall of the outer container with said valve nipple extending through the dispensing valve aperture in the side wall of the outer container with said open end thereof in the interior of the outer container;

a hollow liquid conduit with an annular wall and open first and second ends, interconnected at its first end to said open end of said valve nipple, and having a shoulder extending outwardly from said annular wall near the second end of said liquid conduit;

a hollow connecting nipple with open first and second ends and a side wall, said first end to receive said second end of said liquid conduit into the interior of said connecting nipple with said shoulder of said liquid conduit received against said first end of said connecting nipple, and said second end to releasably receive the neck of the bottle therein in liquid-tight relation, said connecting nipple being interconnected intermediate its first and second ends to said bottle retaining means such that said connecting nipple and the bottle are in coaxial alignment with the bottle disposed in said bottle retaining means and with the neck of the bottle received in said second end of said connecting nipple, said connecting nipple further having an annular first ledge extending from the inner surface of said connecting nipple and defining a central aperture surrounded by said first ledge;

an impeding valve member with an elongate shank, having first and second ends, disposed in the interior of said connecting nipple with said shank extending through said central aperture with the first end of said shank extending beyond said first ledge toward said first end of said connecting nipple and with the second end of said shank extending beyond said first ledge toward said second end of said connecting nipple, said impeding valve member having a second ledge extending outwardly from said shank near said first end thereof between said shank and the inner surface of said connecting nipple, a sealing cap interconnected to said second end of said shank and extending outwardly from said shank so as to form an annular sealing surface to be received against the upper surface of said first ledge around said central aperture to seal against the flow of liquid therethrough, said shank being penetrated by one or more discharge ports extending from the outer surface thereof adjacent to said second end to said first end thereof, each forming a passageway for the flow of liquid therethrough, and including a coil spring disposed around said shank between said first ledge of said outlet nipple and said second ledge of said shank so as to force said valve member toward the first end of said connecting nipple and to force said annular sealing surface of said valve member against the upper surface of said first ledge until said second end of said liquid conduit is received in said connecting nipple and forces said valve member toward second end of said connecting nipple, removing said annular sealing surface from contact with said first ledge, and allowing liquid to flow from the interior of the bottle into said connecting nipple, past said sealing cap, through said discharge ports, said connecting nipple and said liquid conduit to said dispensing valve assembly; and a vent assembly to allow air to enter the bottle as liquid is dispensed therefrom, including a vent aperture extending through said side wall of said connecting nipple above said first ledge of said connecting nipple, and an elongate hollow vent tube with first and second open ends, to form a passageway for the flow of air to the interior of the bottle, said vent tube extending through said vent aperture and interconnected at its outer surface to said connecting nipple, said vent tube being formed and disposed relative to said connecting nipple such that the first end of said vent tube extends beyond said second end of said connecting nipple so as to extend into and through the majority of the length of the interior of a bottle connected to said connecting nipple and such that the second end of said vent tube extends from said connecting nipple through a majority of the length of the side wall of the outer container with said bottle retaining means connected in the interior of the outer container.

18. The liquid dispensing apparatus of claim 17, wherein said bottle retaining means comprises a hollow body having a bottom, a side wall, and a top, said bottom including a connecting aperture with said connecting nipple extending therethrough and interconnected thereto, and said top having an opening therein, coaxially aligned with said connecting aperture and of sufficient size to receive the bottle from which liquid is to be dispensed, and a cap to releasably close said opening.

19. The liquid dispensing apparatus of claim 17, wherein said connecting means comprises one or more lugs disposed on the exterior of said bottle retaining means, and an elongate member having an open ended slot therein to receive said one or more lugs in sliding relation therewith, said member to be attached to the inner surface of the outer container.

20. The liquid dispensing apparatus of claim 17, wherein said vent assembly further includes a check valve disposed in the air passageway formed by said vent tube, to allow air to flow through said vent tube from the exterior to the interior of the bottle and prevent air or liquid from flowing from the interior of the bottle to the exterior thereof through said vent tube.

* * * * *